US010894641B2

(12) United States Patent
Cheng et al.

(10) Patent No.: US 10,894,641 B2
(45) Date of Patent: Jan. 19, 2021

(54) ADHESIVELY CLOSED PACKAGING SYSTEMS

(71) Applicant: L'OREAL, Paris (FR)

(72) Inventors: Wenzhen Cheng, Clark, NJ (US); William Blake Soeters, Middletown, NJ (US)

(73) Assignee: L'OREAL, Paris (FR)

( * ) Notice: Subject to any disclaimer, the term of this patent is extended or adjusted under 35 U.S.C. 154(b) by 43 days.

(21) Appl. No.: 16/138,225

(22) Filed: Sep. 21, 2018

(65) Prior Publication Data

US 2020/0095038 A1 Mar. 26, 2020

(51) Int. Cl.

| | |
|---|---|
| ***B65D 53/06*** | (2006.01) |
| ***B65D 47/08*** | (2006.01) |
| ***A45D 33/00*** | (2006.01) |
| ***B65D 43/02*** | (2006.01) |
| ***B65B 7/26*** | (2006.01) |
| ***B65D 55/02*** | (2006.01) |

(52) U.S. Cl.

CPC ..... *B65D 53/06* (2013.01); *A45D 33/00* (2013.01); *B65B 7/26* (2013.01); *B65D 43/0212* (2013.01); *B65D 47/0838* (2013.01); *B65D 55/02* (2013.01)

(58) Field of Classification Search

CPC .... B65D 51/20; B65D 53/06; B65D 2401/15; B65D 2547/066; A45D 33/006; A45D 2200/051; A45D 40/22

See application file for complete search history.

(56) References Cited

U.S. PATENT DOCUMENTS

| | | | | |
|---|---|---|---|---|
| 2,737,189 | A * | 3/1956 | Morningstar | A45D 33/006 132/305 |
| 5,147,054 | A | 9/1992 | Pehr | |
| 5,799,840 | A | 9/1998 | Mogard | |
| 5,875,795 | A * | 3/1999 | Bouix | A45C 11/22 132/293 |
| 5,896,866 | A * | 4/1999 | Quennessen | A45C 13/008 132/293 |
| 6,655,557 | B2 | 12/2003 | Rousselet et al. | |
| 8,413,832 | B2 | 4/2013 | Mazurkiewicz et al. | |
| 9,210,984 | B2 * | 12/2015 | Byeon | A45D 33/006 |
| 2014/0034663 | A1 | 2/2014 | Königseder et al. | |
| 2015/0314934 | A1 * | 11/2015 | Eberlein | A45D 33/006 215/243 |

FOREIGN PATENT DOCUMENTS

| | | |
|---|---|---|
| CN | 203608988 U | 5/2014 |
| FR | 2741042 A | 5/1997 |

* cited by examiner

*Primary Examiner* — Shawn M Braden

(74) *Attorney, Agent, or Firm* — Christensen O'Connor Johnson Kindness PLLC

(57) ABSTRACT

A packaging system includes a base, a lid, a closure structure, and an adhesive deposit. The base has a well. The lid is hingeably connected to the base and has a user input region and a protrusion projecting into the well. The closure structure is configured for releasably retaining the lid in a closed position relative to the base. The adhesive deposit is located within the well and at least partially surrounds the protrusion, and forms a first plurality of adhesive bonds with the well and a second plurality of adhesive bonds with the protrusion. The second plurality of adhesive bonds and the closure structure are configured to exert a combined retention force of at least 20N.

17 Claims, 13 Drawing Sheets

ADHESIVELY CLOSED PACKAGING SYSTEMS

SUMMARY

The present disclosure is directed to, among other things, representative embodiments of packaging systems. Representative packaging systems generally include a base, a lid, a closure structure, and an adhesive deposit. The base has a well. The lid is hingeably connected to the base and has a user input region and a protrusion projecting into the well. The closure structure is configured for releasably retaining the lid in a closed position relative to the base. The adhesive deposit is located within the well and at least partially surrounds the protrusion, and forms a first plurality of adhesive bonds with the well and a second plurality of adhesive bonds with the protrusion. The second plurality of adhesive bonds and the closure structure are configured to exert a combined retention force of at least 20N.

In one aspect, the closure structure alone may be configured to exert a retention force of at least 10N.

In one aspect, the closure structure may include part of a hinge, wherein the second plurality of adhesive bonds is offset from the user input region by less than 10.0 mm in between the user input region and the hinge.

In one aspect, the first plurality of adhesive bonds may cover a first surface area of the well and the second plurality of adhesive bonds may cover a second surface area of the lid that is 50 $mm^2$ to 150 $mm^2$. In one aspect, the first surface area may be greater than the second surface area.

In one aspect, a ratio of the first surface area to the second surface area is 2.0 to 10.0.

In one aspect, the adhesive deposit contains less than or equal to 0.3 g of adhesive.

In one aspect, the adhesive deposit contains less than or equal to 0.5 ml of adhesive.

In one aspect, at least one of the first plurality of adhesive bonds is formed at a surface having a first roughness, and at least one of the second plurality of adhesive bonds is formed at a surface having a second roughness, the first roughness being greater than the second roughness.

In one aspect, the closure structure is part of at least one of the base and the lid.

In one aspect, the second plurality of adhesive bonds is configured to permanently retain the adhesive deposit within the well.

In one aspect, the well is open on a bottom side. In one aspect, an upper wall of the base obstructs the adhesive deposit from being removed from the well.

In one aspect, the packaging system may include a container that attaches to the base.

In one aspect, the packaging system may include a second protrusion opening that opens into a second well, and a second protrusion projecting through the second protrusion opening and into the second well. In one aspect, the protrusion and the second protrusion are located on opposite sides of the user input region. In one aspect, the packaging system may include a tray configured to fit within the base, wherein the base, tray, and the lid together substantially form a makeup compact.

The present disclosure is also directed to, among other things, representative methods for securing a product during e-commerce fulfillment. One representative method generally includes providing a base and a lid hingeably connected to the base, the lid having a protrusion and a user input region, the base having a well configured to receive at least part of the protrusion, applying an adhesive deposit into the well, closing the lid relative to the base such that at least part of the protrusion extends into the well, and allowing the adhesive deposit to dry.

In one aspect, closing the lid may occur prior to applying the adhesive deposit into the well. In one aspect, the method may include turning the base upside down prior to applying the adhesive deposit. In one aspect, applying the adhesive deposit may include applying a drop of adhesive through an open bottom of the well.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure provides examples of containers, caps, and other closeable containers that are optimized for e-commerce fulfillment, resist tampering, and provide evidence of tampering. The problem solved by the inventive solutions arises from more frequent and greater forces exerted on bottles, makeup compacts, and other closable containers in e-commerce distribution channels as compared to traditional retail distribution channels. Unlike closable containers purchased via traditional retail distribution channels, where an end user typically transports a closable container (e.g., a shampoo bottle) from the location of sale to the location of use, closable containers purchased via the internet often undergo additional fulfillment, shipping, and other handling steps prior to reaching the end user. During these additional e-commerce steps, closable containers can experience forces that may cause container failure (for example, a lid may inadvertently open, spilling product), and/or may experience tampering. Higher container failure rates contribute to increased costs, customer dissatisfaction, waste, and inconvenience.

To overcome these problems, the present disclosure provides packaging systems that include one or more adhesively-closed lids, such as may be assembled and/or otherwise provided with one or more of a wide variety of packaging, including caps, bases, and/or containers (including bottles, tubs, wells, tubes, vessels, and the like). A wide variety of liquid and solid products may benefit from such lids, such as shampoo, soaps, lotions, medications, cosmetic formulations (including powdered formulations), pharmaceutical formulations, and other formulations. Except where expressly limited, the present disclosure is not intended to be limited to any particular application(s) or formulation.

Figure 1:
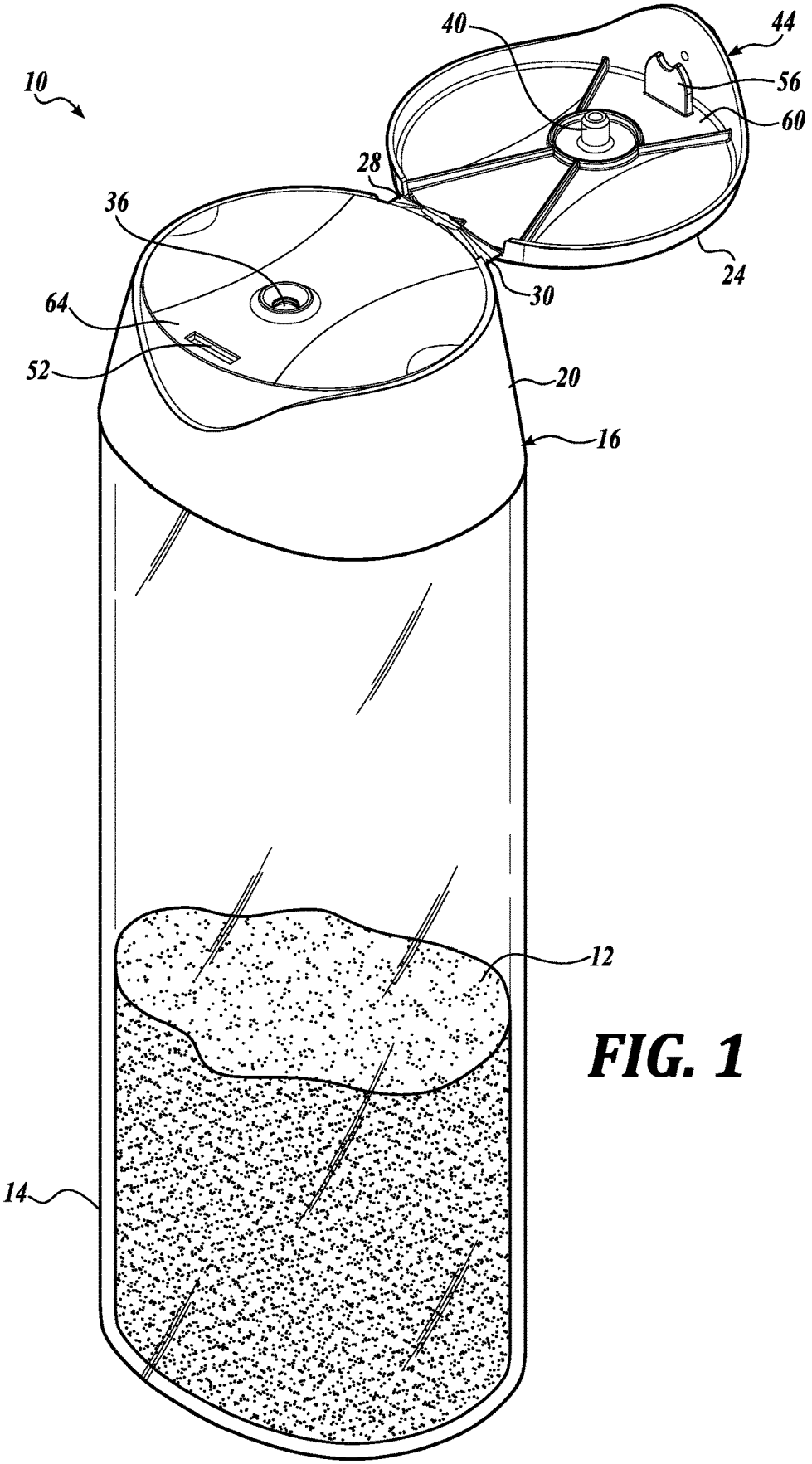
FIG. 1 is a perspective view of a representative system according to the present disclosure, including a representative example of a base and a representative example of a lid.

Referring now to FIG. 1, a representative packaging system 10 includes a container 14 and a cap 16. The cap includes a base 20 and a lid 24. In this embodiment, the container 14 is a bottle, such as may be suitable for holding a product 12, e.g., shampoo, conditioner, body wash, lotion, etc. In some embodiments, the container may be formed by the base and the lid, such as a container to hold a tray for storing dry cosmetic formulations and an applicator. Some embodiments may not include a container. Generally, the container and cap (including the base and the lid), may be manufactured from one or more of a wide variety of materials, including ABS, polypropylene, polystyrene, polyethylene, polyurethane, polyvinylchloride, polybutylene terephthalate, polyester, other plastics, wood-based materials, and metals. The base 20 and the lid 24 of FIG. 1 are manufactured from copolymer polypropylene.

The base 20 and the lid 24 are connected via connecting structure 28 that allows the lid 24 to be moved between an open position and a closed position relative to the base 20. In that regard, FIGS. 1-4 show the lid 24 in an open position, and FIGS. 5-8 show the lid 24 in the closed position. As used in this application, the term "open position" refers to any position of the lid 24 relative to the base 20 in which a space between the base 20 and the lid 24 may be accessed, or any position in which contents contained within the container 14 may: be dispensed; pour out; fall out; blow out; escape; be accessed by a user; otherwise exit the packaging system 10. The term "closed position" refers to any non-open position of the lid 24 relative to the base 20 in which 1) the lid 24 makes contact with the base 20 and in which a space between the base 20 and the lid 24 may not be accessed, or 2) any contents contained within the container 14 cannot: be dispensed; pour out; fall out; blow out; escape; be accessed by a user; or otherwise exit the packaging system 10. Although this application refers to a singular "open position" and singular "closed position," there could potentially be more than one open position and closed position.

In FIGS. 1-8, the base 20 and lid 24 are an integrally-formed living hinge type of cap, in which the connecting structure 28 is a pliable and resilient hinge formed of the same material as the base 20 and the lid 24, so as to enable the lid 24 to move between the open and closed positions. In some embodiments, the connecting structure need not be a living hinge type connector, but may include one or more components that are distinct from the base and/or the cap (such as a hinge or an axle), and/or formed from different materials. The base 20 of FIG. 8 includes a snap-fit engagement structure 32 to engage the container 14, but in some embodiments the base may be joined to the container via threads, friction fit, adhesive, latch, weld, or other removable or permanent connection structure. In some embodiments, the base and the lid may form part of the container itself, or may enclose the container.

Figure 6:
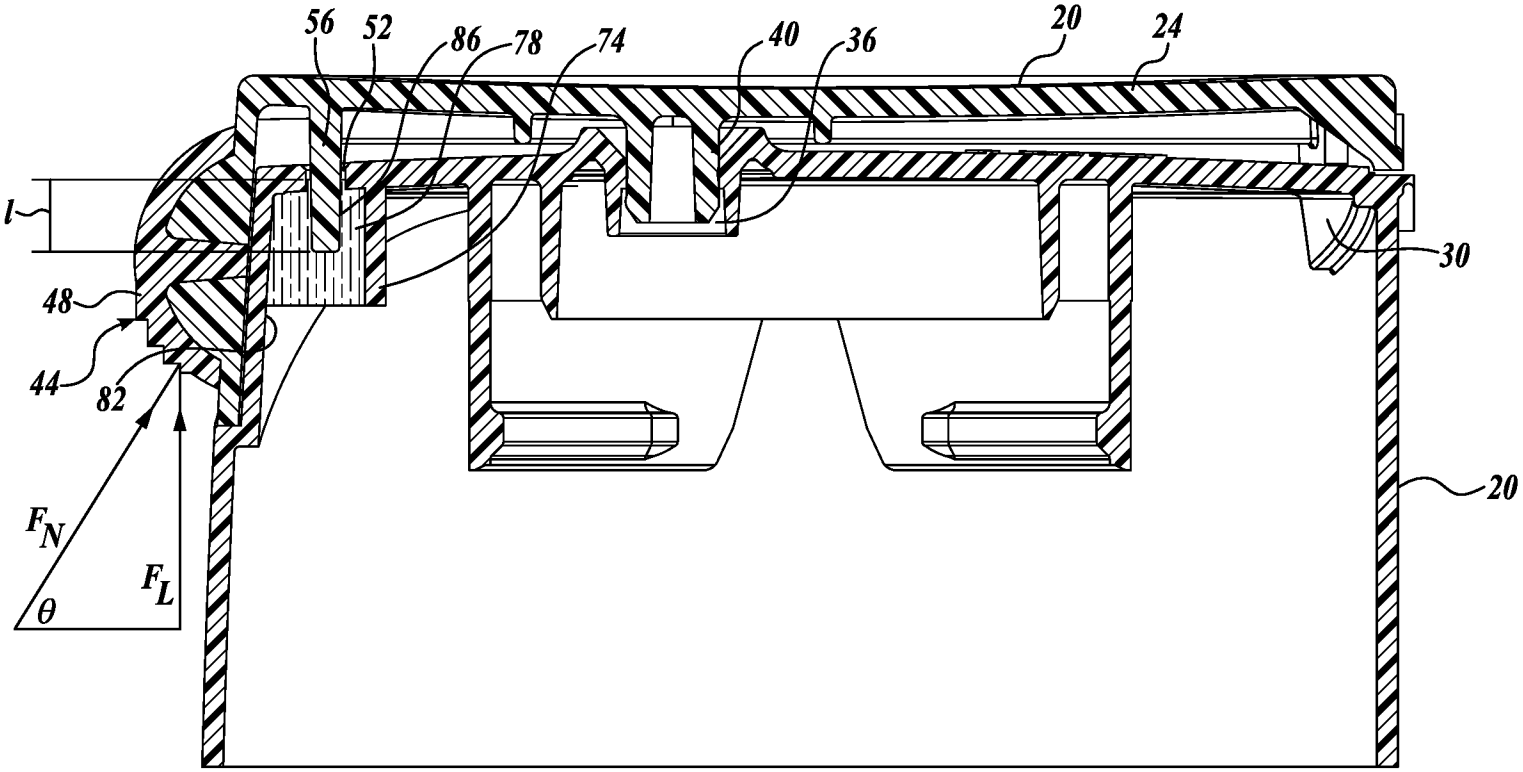
FIG. 6 is a side section view of the base and lid of FIG. 1, showing the lid in a closed position.

Referring to FIGS. 1-3 and 6, the base 20 includes a dispensing opening 36 through which contents may exit the container 14. To prevent contents from inadvertently exiting the packaging system 10 via the dispensing opening 36 when the lid 24 is in the closed position, the lid 24 includes a plug 40 that is complementary to the dispensing opening 36 of the base 20. As shown in FIG. 6, when the lid 24 is in the closed position, the plug 40 substantially occupies the dispensing opening 36, and in some embodiments, forms a seal between the plug 40 and the wall of the opening 36.

Figure 5:
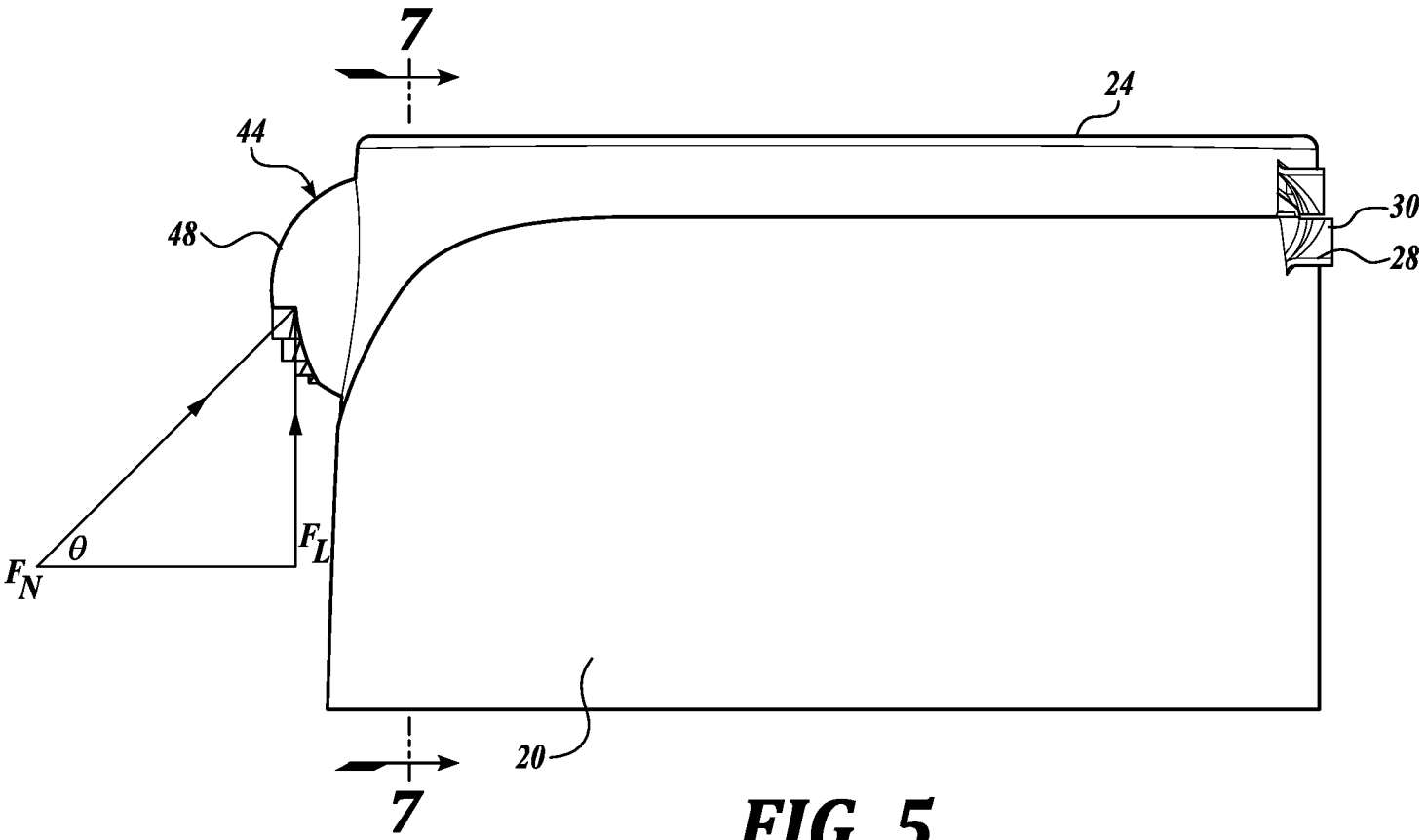
FIG. 5 is a side view of the base and lid of FIG. 1, showing the lid in a closed position.

Referring now to FIGS. 5-6, the lid 24 includes a user input region 44 that is designed to receive a lid force $F_L$ that tends to move the lid 24 from the closed position to an open position. For example, a subject may exert a lid force on the user input region 44 with a thumb to open the lid 24. As used herein, the lid force $F_L$ refers to the vertical component of any nominal force $F_N$ applied to the user input region 44 of the lid 24 at angle θ. In other words, the lid force $F_L=F_N \sin \theta$. The user input region 44 may include integral and/or separate elements of the lid 24 and/or the base 20 to facilitate the application of the lid force $F_L$. For example, the user input region 44 may include a projections, such as a ball 48, that projects away from the lid 24 in order to provide a surface that a user may push against. In some embodiments, the user input region may include one or more of a recess, a lip, textured area, or similar feature to facilitate application of lid forces. In some embodiments, the user input region may include structure or elements of the base.

The base 20 and/or the lid 24 may optionally include one or more closure structures 30 designed to increase the minimum lid force $F_L$ required to move the lid 24 from the closed position to the open position. Such closure structures 30 may prevent inadvertent opening of the lid 24, and are exclusive from the adhesive bonds described below. For example, in FIGS. 1-7, the connecting structure 28—a living hinge—is also the closure structure 30 because its geometry causes it to resist opening of the lid 24. In some embodiments such as in FIGS. 1-7, the closure structure may be part of at least one of the base and the lid. In another example, the interaction between the plug 40 and the opening 36 can be configured to provide resistance to lid opening (increase the minimum lid force $F_L$ required to move the lid 24 from the closed position to the open position), such as from an interference fit, a sealed fit, etc.

In some embodiments, closure structure may include distinct components or may be integrally formed from other aspects of the lid and/or base, such as one or more complementary protrusions and detents, snap-fit mechanisms, cams, latches, friction fit mechanisms, etc., that tend to retain the lid in the closed position. A variety of closure structures may be useful in the inventive packaging systems disclosed herein. In embodiments having closure structure, a lid force of at least about 10N, at least about 20N, about 0.1N to about 35N, e.g., about 10N to about 30N, about 22N to about 25N, may be required in order to move the lid to the open position by overcoming any retention force created by the closure structure alone (exclusive from any retention force created by adhesive bonds, described below). Some embodiments may not include any closure structure.

Figure 2:
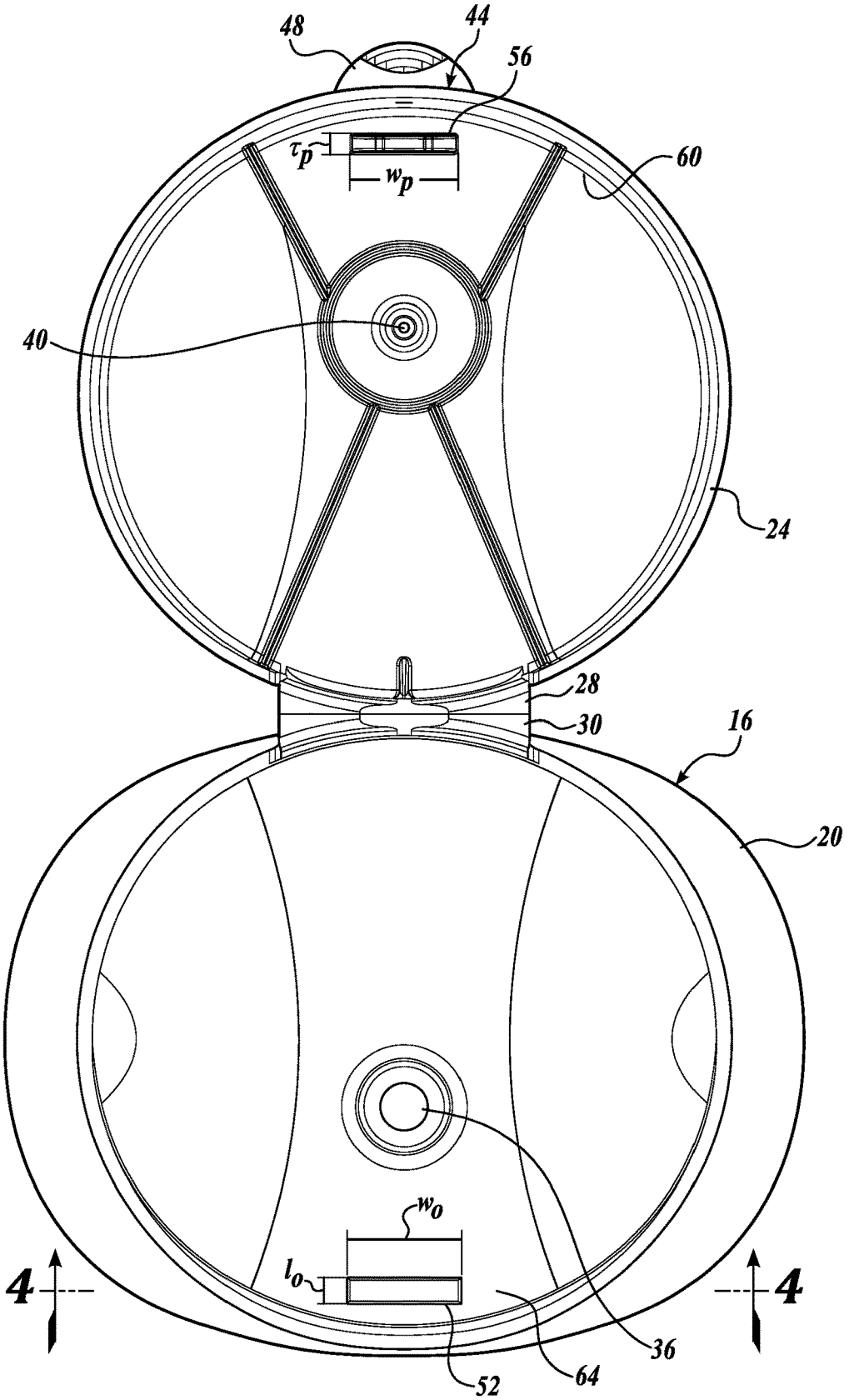
FIG. 2 is a top view of the base and lid of FIG. 1.
Figure 3:
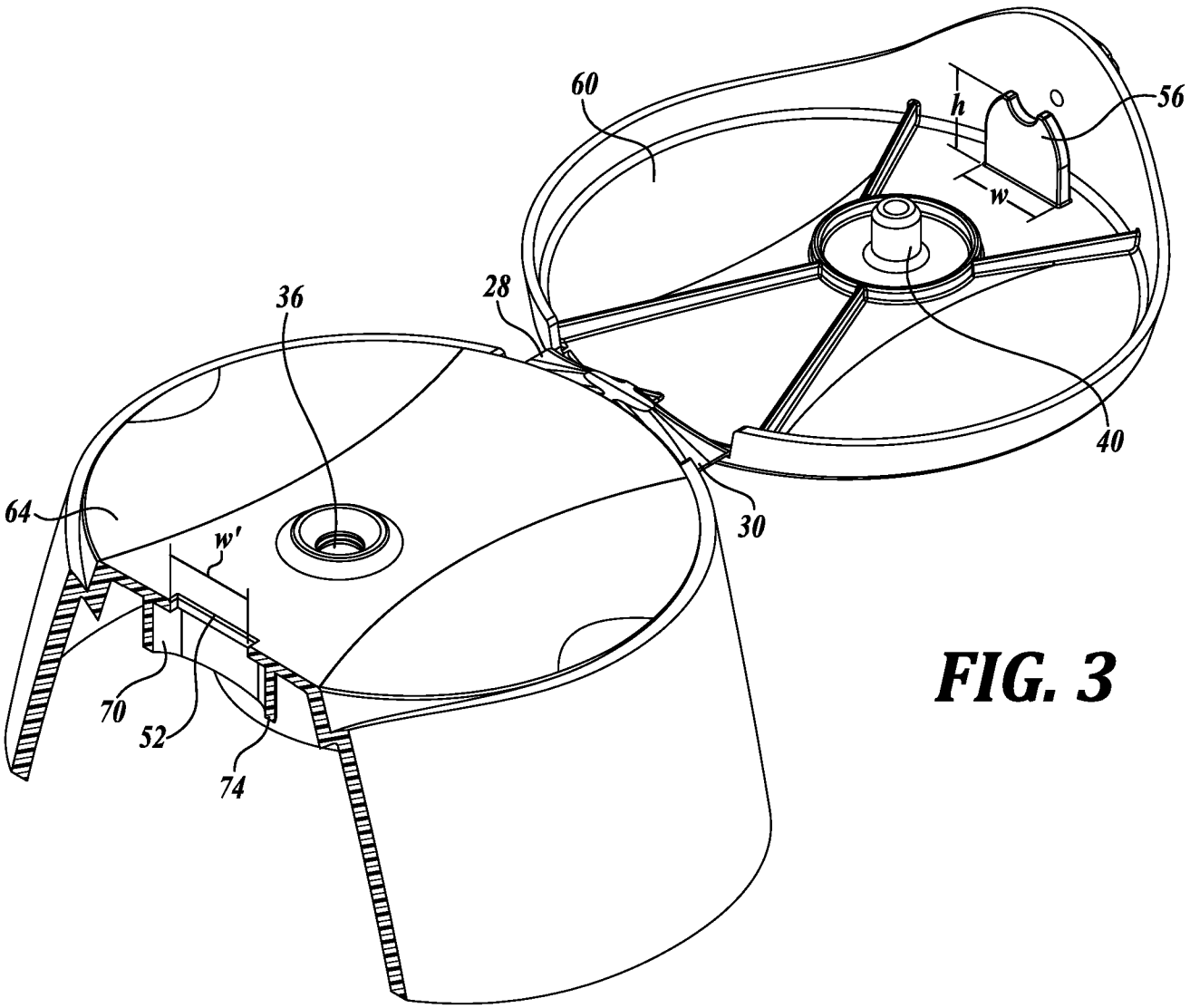
FIG. 3 is a perspective section view of the base and lid of FIG. 1, showing the lid in an open position.
Figure 4:
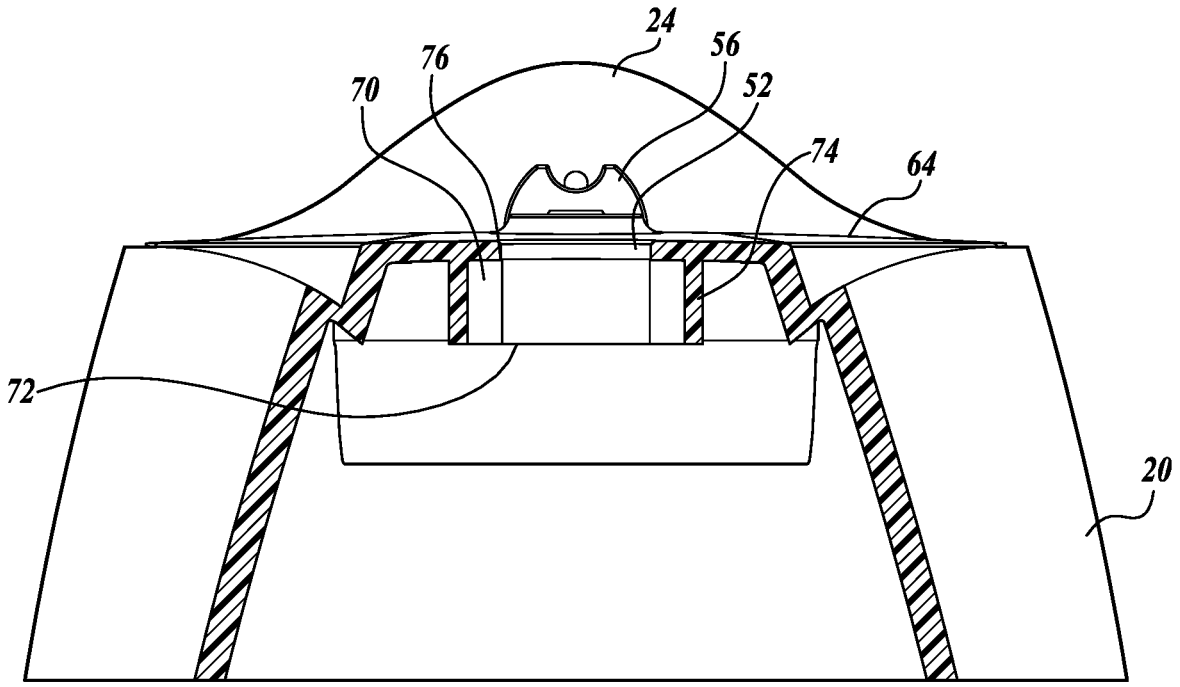
FIG. 4 is a front section view of the base and lid of FIG. 1, showing the lid in an open position.
Figure 7:
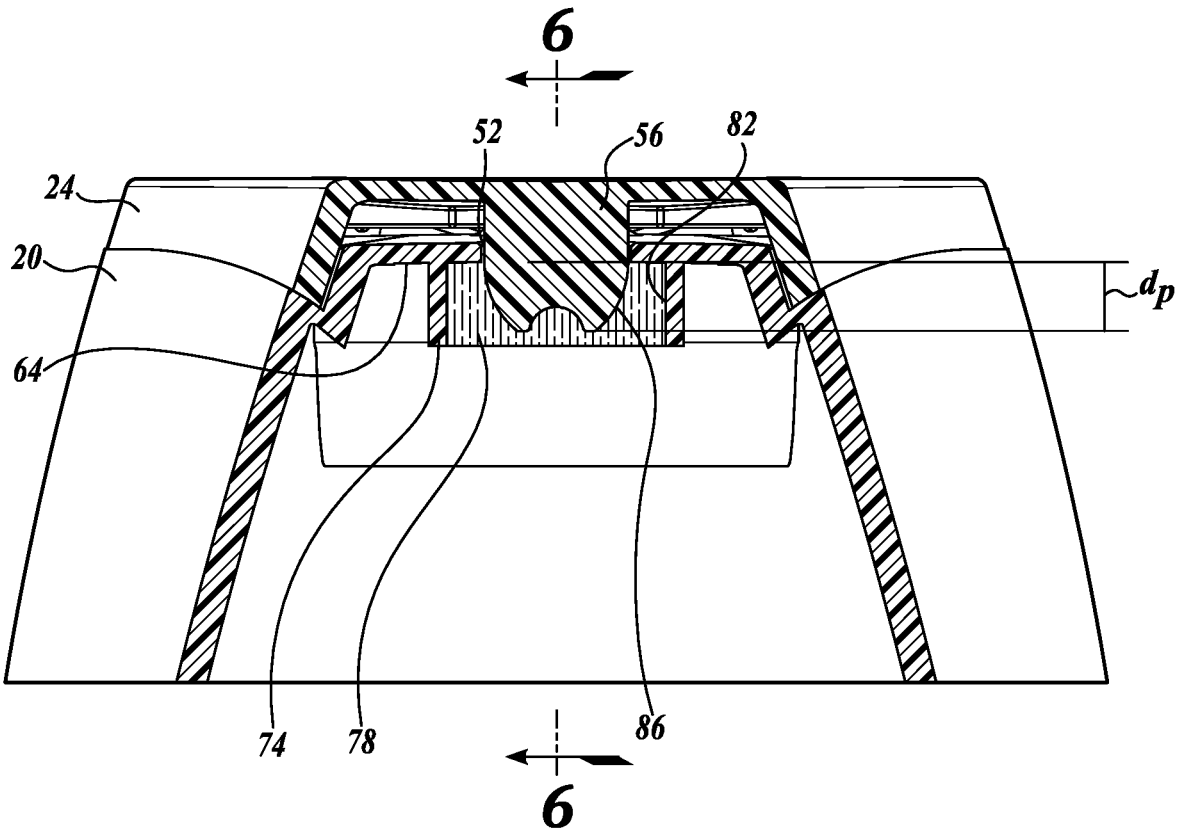
FIG. 7 is another front section view of the base and lid of FIG. 1, showing the lid in a closed position.
Figure 8:
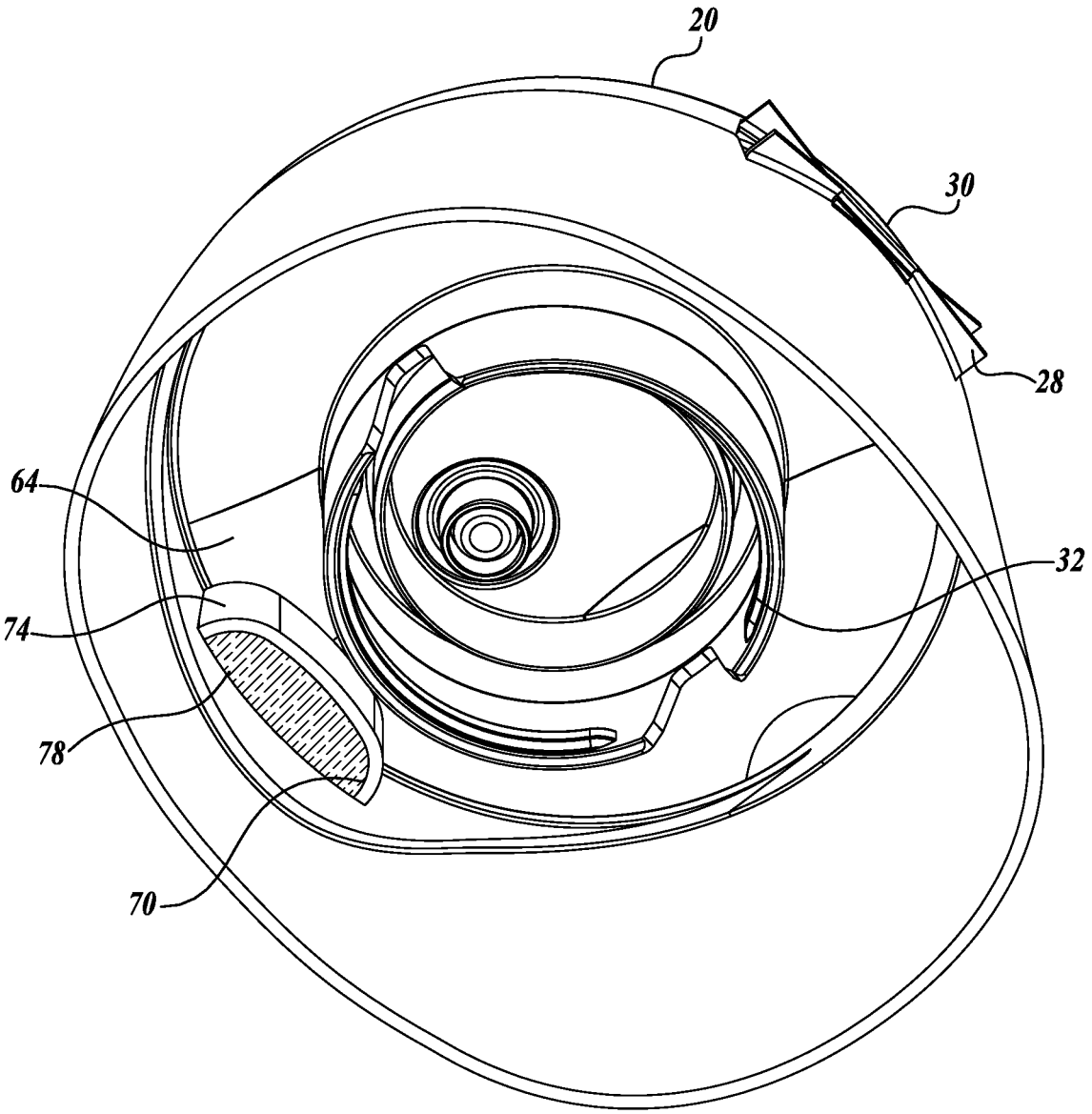
FIG. 8 is a lower perspective view of the base and lid of FIG. 1, showing a bottom side.

Referring to FIGS. 1-4, the base 20 includes a protrusion opening 52 that is sized and positioned to receive a protrusion 56, which projects away from a lower surface 60 of the lid 24. The protrusion opening 52 extends through an upper wall 64 of the base 20 in a location that corresponds to the protrusion 56 in the closed position. As shown in FIG. 2, the protrusion opening 52 has a rectangular shape with a length $l_0$ of about 1.9 mm and a width $w_0$ of about 9.9 mm. Referring to FIG. 4 (see also FIGS. 6-8), the protrusion opening 52 opens into a well 70, which is a partially enclosed space located on a bottom side of the upper wall 64 of the base 20. The well 70 is open at a lower end 72, and at an upper end 76 where the protrusion opening 52 and the well 70 are in fluid communication. Some embodiments may not include a well, but in those embodiments with a well, the well has a volume of about 0.2 ml to about 5.0 ml, for example about 0.25 ml, about 0.30 ml, about 0.35 ml, about 0.40 ml, about 0.45 ml, about 0.50 ml, or any other volume in that range. Referring to FIG. 8, the well 70 is bounded by interior surfaces of the base 20 and by a dam 74, which has a single wall with partial-ellipse shape in this embodiment. In some embodiments, the dam may include more than one wall, each of which may be substantially planar or non-planar.

As shown in FIG. 1, the protrusion 56 is a flat, spade-shaped tab with a notched end that extends away from the lower surface 60 of the lid 24. Referring to FIG. 2, the protrusion 56 has a rectangular cross section with a thickness $t_p$ (1.5 mm in this embodiment, for example) and width $w_p$ (9.5 mm in this embodiment, for example)—each dimension being slightly smaller than the corresponding dimension of the protrusion opening. FIG. 3 shows that the protrusion 56 has a height $h_p$ (8.5 mm in this embodiment, for example). When the lid 24 is in the closed position, the protrusion 56 extends through the protrusion opening 52 and into the well 70, as shown in FIGS. 6-8. The protrusion 56 may extend into the well 70 by a depth $d_p$ of about 1.0 mm to about 10.0 mm, e.g., about 4.0 mm, about 4.5 mm, about 5.0 mm, about 5.5 mm, about 6.0 mm, or any other depth in that range. In the embodiment of FIGS. 1-8, the depth $d_p$ is about 5.5 mm. In some embodiments, the shape of the protrusion opening and the protrusion may differ. For example, the protrusion opening and the protrusion may have round cross sections, a different geometrical cross section, or a non-geometrical cross section. In some embodiments, the protrusion might have greater dimensions than the embodiment of FIGS. 1-8, for example to increase the surface area on which a plurality of adhesive bonds form, as described below. In some embodiments, the relative positions of the protrusion, protrusion opening, and well may be reversed, i.e., the protrusion may extend away from the base and the protrusion opening and well may exist within the lid.

Packaging systems of the present disclosure include one or more adhesive deposits that prevent the lid from inadvertently opening relative to the base, such as during e-commerce fulfillment. The adhesive deposits form a first plurality of adhesive bonds with surfaces of the base and a second plurality of adhesive bonds with surfaces of the lid, and certain of the adhesive bonds (e.g., the second plurality of adhesive bonds) may be designed to permanently break after application of a lid force that exceeds a certain threshold.

Suitable adhesive formulations include a wide variety of adhesives exhibiting a relatively high bonding strength and temperature resistance, a relatively low drying or curing time, and a predictable and consistent bonding strength. Polyolefins (e.g., hot melt polyolefins) represent one non-limiting type of suitable adhesive, for example TECHNOMELT® 0430™ and AS 7875™ offered by Henkel AG & Co, and other polyolefins having similar properties. Each adhesive deposit may include about 0.1 g to about 5.0 g of adhesive, e.g., about 0.1 g, about 0.2 g, about 0.3 g, about 0.4 g, about 0.5 g, about 0.6 g, about 0.7 g, about 0.8 g, about 0.9 g, about 1.0 g, or any other value in that range, preferably about 0.2 g to about 1.0 g. Each adhesive deposit may include about 0.1 ml to about 5.0 ml of adhesive, e.g., about 0.1 ml, about 0.2 ml, about 0.3 ml, about 0.4 ml, about 0.5 ml, about 0.6 ml, about 0.7 ml, about 0.8 ml, about 0.9 ml, about 1.0 ml, or any other value in that range, and preferably about 0.1 ml to about 1.0 ml.

Referring to FIGS. 6-8, an adhesive deposit 78 having, for example, 0.3 ml/0.24 g of adhesive is located within the well 70 and surrounds a portion of the protrusion 56 when the lid 24 is in the closed position. As shown in FIGS. 6-7, the adhesive deposit 78 forms a first plurality of adhesive bonds 82 where the adhesive deposit 78 meets surfaces of the well 70, and a second plurality of adhesive bonds 86 where the adhesive deposit 70 meets surfaces of the protrusion 56. More particularly, the first plurality of adhesive bonds 82 forms on interior surfaces of the base 20 and the dam 74, and the second plurality of adhesive bonds 86 forms on exterior surfaces of the protrusion 56. In some embodiments, adhesive bonds may form on a different number of surfaces.

Generally, an adhesive deposit could be located at any interface between the base and the lid; however, it is preferably located relatively near the user input region in order to reduce the multiplication of force exerted on the adhesive deposit due to inherent leverage. In other words, the location of the adhesive deposit may be selected to reduce the amount of adhesive necessary to counteract a given lid force. Referring to FIG. 6, the second plurality of adhesive bonds 86 (in this case, the bonds designed to break first) are offset from the furthest point of the user input region 44 by a distance z, which is less than or equal to about 6.3 mm, for example, in this embodiment. The distance z extends in a direction that is parallel to the section plane of FIG. 6, which bisects the user input region 44 and the connecting structure 28. Generally, the distance z extends in a direction between the user input region and the connecting structure (e.g., a hinge), such that a greater z value places the adhesive bonds further away from the connecting structure and tends to increase the leverage exerted on the adhesive deposit by a lid force. In some embodiments, the distance z may be between about 0.1 mm to about 50.0 mm, for example about 2.5 mm, about 5.0 mm, about 10.0 mm, about 20.0 mm, about 30.0 mm, about 40.0 mm, or any other distance in that range.

The adhesive bonds 82, 86 formed between the adhesive deposit 78 and surfaces of the base 20 and lid 24 increase the lid force $F_L$ required to move the lid 24 from the closed position to the open position in the first instance after formation of the adhesive bonds 82, 86, due to retention forces created by the adhesive bonds 82, 86 and the closure structure 30. Generally, at the time of the initial opening of the lid after formation of the adhesive bonds (e.g., the first time an end user opens the container), the lid force $F_L$ necessary to overcome the retention force created by the adhesive bonds and any closure structure (i.e., to break certain adhesive bonds) may be at least about 20N, at least about 30N, or about 15N to about 60N, for example about 18N, at least about 20N, about 25N, about 26N, about 27N, about 28N, about 29N, about 30N, about 31N, about 32N, about 33N, about 34N, about 35N, about 44N, about 45N, about 46N, about 47N, about 48N, about 49N, about 50N, or any other force in that range. In other words, the adhesive bonds and the closure structure are configured to retain the lid in the closed position until the application of a lid force $F_L$ in excess of about 15N to about 60N, at which time certain of the adhesive bonds are configured to break. Of the total retention force exerted by the adhesive bonds and the closure structure, the adhesive bonds may alone account for at least about 10N, at least about 20N, or about 5N to about 55N, for example about 10N, about 25N, about 26N, about 27N, about 28N, about 29N, about 30N, about 31N, about 32N, about 33N, about 34N, about 35N, or any other force in that range. Similarly, the closure structure may alone account for at least about 10N, at least about 20N, or about 5N to about 55N, for example about 10N, about 25N, about 26N, about 27N, about 28N, about 29N, about 30N, about 31N, about 32N, about 33N, about 34N, about 35N, or any other force in that range.

When the lid force $F_L$ exceeds the retention force exerted by any closure structure and the adhesive bonds, certain of the adhesive bonds break, thereby allowing the lid to separate from the adhesive deposit, and allowing the lid to move into the open position. Thereafter and during subsequent openings of the lid, only the closure structure exerts a retention force because certain adhesive bonds have broken, and consequently the necessary lid force to open the lid is reduced. In the embodiment of FIGS. 6-8, the closure structure 30 and the second plurality of adhesive bonds 86 are configured to withstand an initial lid force $F_L$ of up to about 20N, with the second plurality of adhesive bonds alone being configured to withstand an initial lid force of up to about 10N. A lid force $F_L$ of more than 20N will cause the closure structure 30 to release and the second plurality of adhesive bonds 86 to break. In some embodiments, the closure structure 30 and the second plurality of adhesive bonds 86 are configured to withstand an initial lid force $F_L$ of at least about 20N, with the closure structure alone being configured to withstand an initial lid force of at least about 10N. In the embodiment of FIGS. 6-8, the first plurality of adhesive bonds 82 (i.e., those formed with surfaces of the base 20) are not designed to break. Because the first plurality of adhesive bonds 82 remain intact and because the upper wall 64 of the base 20 obstructs the adhesive deposit 78 from being removed from the well 70, the adhesive deposit 78 remains in the well 70 after the second plurality of adhesive bonds 86 break.

Generally, the strength of any adhesive bond correlates to the surface area covered by that bond. In the embodiment of FIGS. 1-8, the adhesive deposit 78 covers about 250 $mm^2$ of surfaces of the base 20 (including the well 70) and about 70 $mm^2$ of surfaces of the lid 24 (including the protrusion 56). In other words, the first plurality of adhesive bonds 82 about 250 $mm^2$ and the second plurality of adhesive bonds 86 cover about 70 $mm^2$. In some embodiments, each adhesive deposit may cover about 50 $mm^2$ to about 500 $mm^2$ of surface area of the base (including the well), for example about 100 $mm^2$, about 125 $mm^2$, about 150 $mm^2$, about 175 $mm^2$, about 200 $mm^2$, about 300 $mm^2$, about 400 $mm^2$, about 450 $mm^2$, about 500 $mm^2$, or any other surface area within that range, regardless of how much surface area of the lid the adhesive deposit covers. Therefore, the first plurality of adhesive bonds may cover the same amount of surface area. The adhesive deposit may also cover about 50 $mm^2$ to about 500 $mm^2$ of surface area of the lid (including the protrusion), including all exemplary values described above with respect to the base, regardless of how much surface area of the base the adhesive deposit covers. Therefore, the second plurality of adhesive bonds may cover the same amount of surface area. In FIGS. 6-8, the adhesive deposit 78 covers a different surface area of the base 20 (about 250 $mm^2$) as compared to the lid 24 (about 70 $mm^2$). Therefore, the ratio between the surface area of the first plurality of adhesive bonds 82 and the surface area of the second plurality of adhesive bonds 86 is about 3.6. Because the ratio is greater than 1.0, the second plurality of adhesive bonds 86 may break before the first plurality of adhesive bonds 82 (i.e., the adhesive deposit 78 breaks from the lid 24 before the base 20). In some embodiments, the ratio may range from about to about 0.1 to about 10.0, for example about 0.2, about 0.3, about 0.4, about 0.5, about 0.6, about 0.7, about 0.8, about 0.9, about 1.0, about 2.0, about 3.0, about 4.0, about 5.0, about 6.0, about 7.0, about 8.0, about 9.0, and any other ratio in that range. When the aforementioned ratio is greater than 1.0, the second plurality of adhesive bonds may tend to break before the first plurality of adhesive bonds (i.e., break from the lid before the base); when the ratio is less than 1.0, the opposite may be true—the first plurality of adhesive bonds may tend to break before the second plurality of adhesive bonds (i.e., break from the base before the lid). To further control breakage characteristics of the adhesive deposit, one or more surfaces of the lid 24 and/or base 20 may have different roughness properties. All else equal, an adhesive bond will break at a surface having a lower roughness as compared to a surface having a greater roughness.

During manufacture, the adhesive deposit 78 may be applied in a liquid state into the well 70 after closing the lid 24, or shortly before closing the lid 24. The adhesive deposit 78 may be applied into the well 70 directly or via the protrusion opening 52. In the embodiment of FIGS. 1-8, the lid 24 may be closed, the base 20 and lid 24 may be turned upside down, the adhesive deposit 78 may then be applied (e.g., in liquid form, via one or more drops) into the open bottom side of the well 70, and the adhesive deposit 78 may be allowed to dry. In some embodiments, the adhesive may be applied shortly before the lid is closed. In some embodiments, the base and lid are not turned upside down prior to applying the adhesive deposit into the well; rather, the adhesive deposit may be applied through the protrusion opening or an open side of the well.

FIGS. 9-14 show another representative packaging system 100 in the form of a makeup compact. The system includes a base 104 and a lid 108. Some embodiments may have different dimensions and shapes. The base 104 and the lid 108 are hingeably connected via integrally-formed connection structure 112 (a hinge) such that the lid 108 may open and close relative to the base 104, thereby assuming an open position and a closed position (compare FIGS. 9 and 10). In some embodiments, the base and/or lid may be connected by discrete connection structure that is not integrally-formed with the base or lid. The base 104 and lid 108 form a container 116 for a tray 120, which in this embodiment includes a plurality of recesses 124 suitable to store one or more dry cosmetic formulations and an applicator. Some embodiments of representative packaging systems may not include a product tray, may include a product tray that differs from that shown in FIGS. 9-14, or may include another component that is contained within the base and/or lid.

Figure 9:
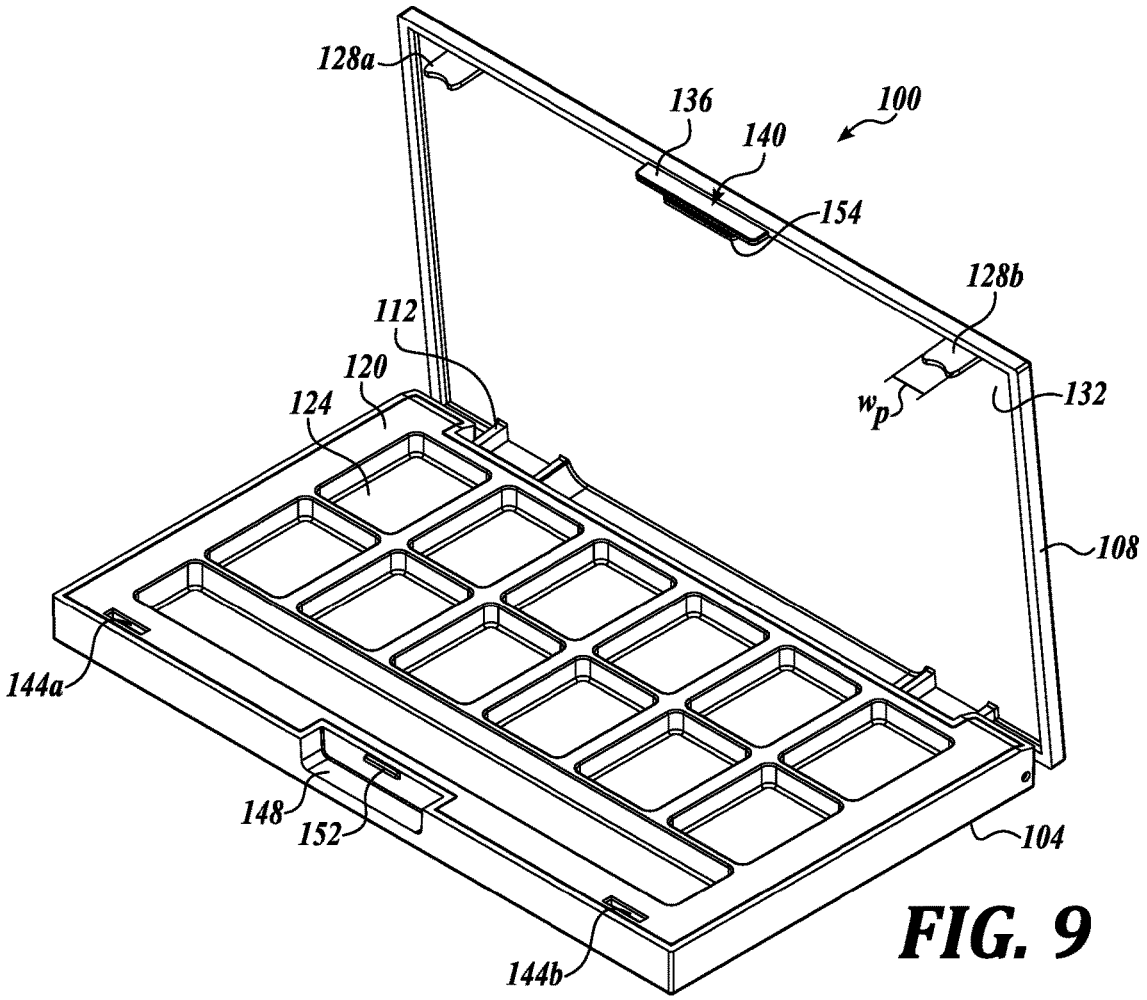
FIG. 9 is a perspective view of another representative system according to the present disclosure, including a representative example of a base and a representative example of a lid.
Figure 11:
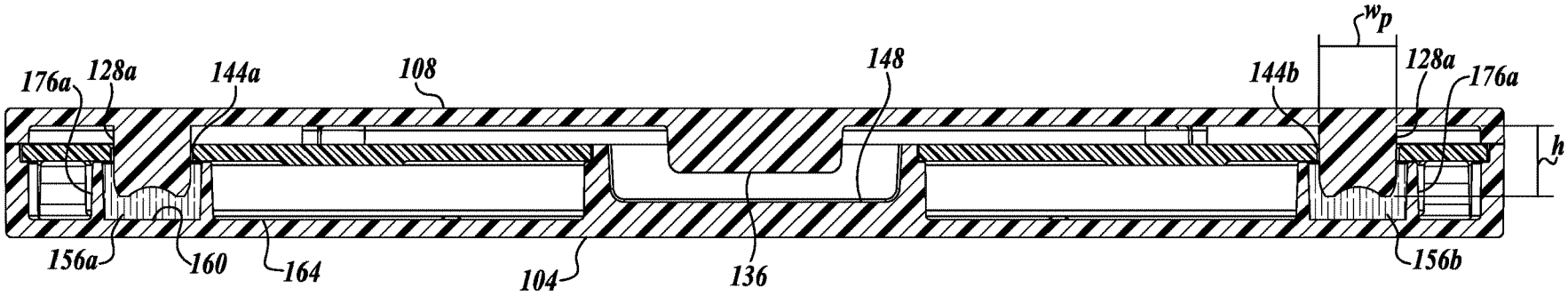
FIG. 11 is a front section view of the base and lid of FIG. 9.

Referring to FIGS. 9 and 11, the lid 108 includes two tab-shaped protrusions **128*a* and 128*b* that extend away from a lower surface 132, and a lip 136 (part of a user input region 140) that extends in substantially the same direction as the protrusions 128*a* and 128*b*. Each protrusion 128 has a width $w_p$ (for example, 6.6 mm in this embodiment), a height $h_p$ (for example, 6.0 mm in this embodiment), a thickness $t_p$ (see FIGS. 13-14**—0.6 mm in this embodiment, for example), and a notched bottom.

In some embodiments, one or more protrusions may have different shapes and/or dimensions. Some embodiments may include a different number of protrusions. The tray 120 includes first and second protrusion openings **144*a* and 144*b*** that are sized and located to receive the first and second protrusions 128*a* and 128*ba*, respectively, when the lid 108 is in the closed position. In some embodiments, one or more protrusion openings may have different shapes and/or dimensions. Some embodiments may have more or fewer protrusion openings. The base 104 also includes a recess 148 that corresponds to the location of the lip 136 when the lid 108 is closed, to enable a user to easily apply a lid force $L_F$ to the lid. The lip 136 and the recess 148 form part of the user input region 140. To resist lid forces $L_F$, closure structure elements 152*a* and 152*b* located on the lid 108 and base 104, respectively, may engage each other when the lid 108 is closed.

Figure 12:
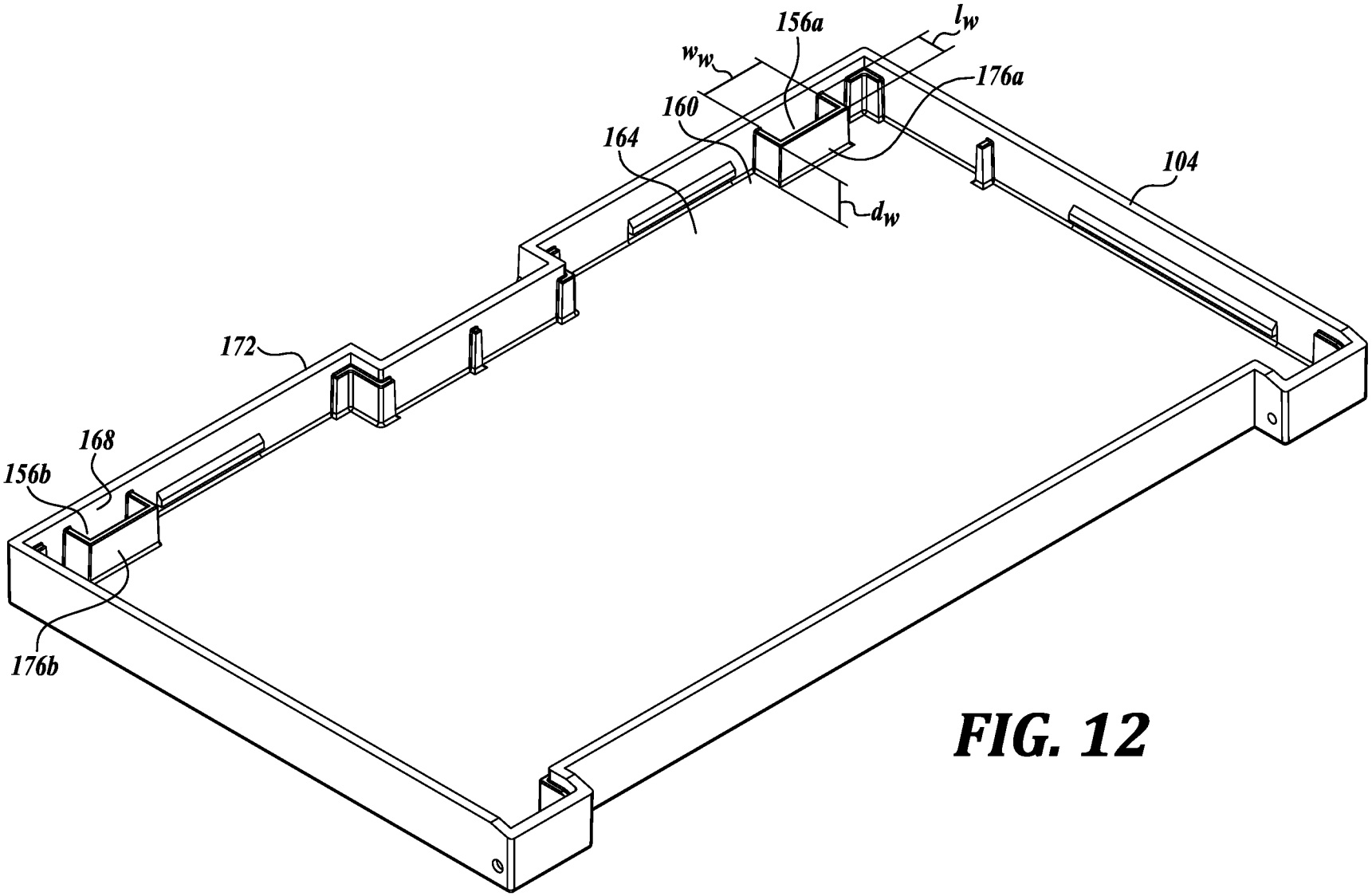
FIG. 12 is a perspective view of the base of FIG. 9.

Referring to FIGS. 11-12, the first and second protrusion openings 144*a* and 144*b* open into a first well 156*a* and a second well 156*b*, respectively, which are partially enclosed spaces located on the base 104 that are designed to store adhesive. The protrusion openings 144*a* and 144*b* and the wells 156*a* and 156*b* are in fluid communication. As shown in FIG. 12, each well 156 has a width $w_w$ (for example, 8.2 mm in this embodiment), a length $l_w$ (for example, 3.0 mm in this embodiment), and a depth $d_w$ (for example, 4.9 mm in this embodiment). Each well 156 is bounded by an upper surface 160 of a lower wall 164 of the base 104, an internal surface 168 of an outer wall 172 of the base 104, and by a three-sided dam 176*a* and 176*b*, respectively.

Figure 13:
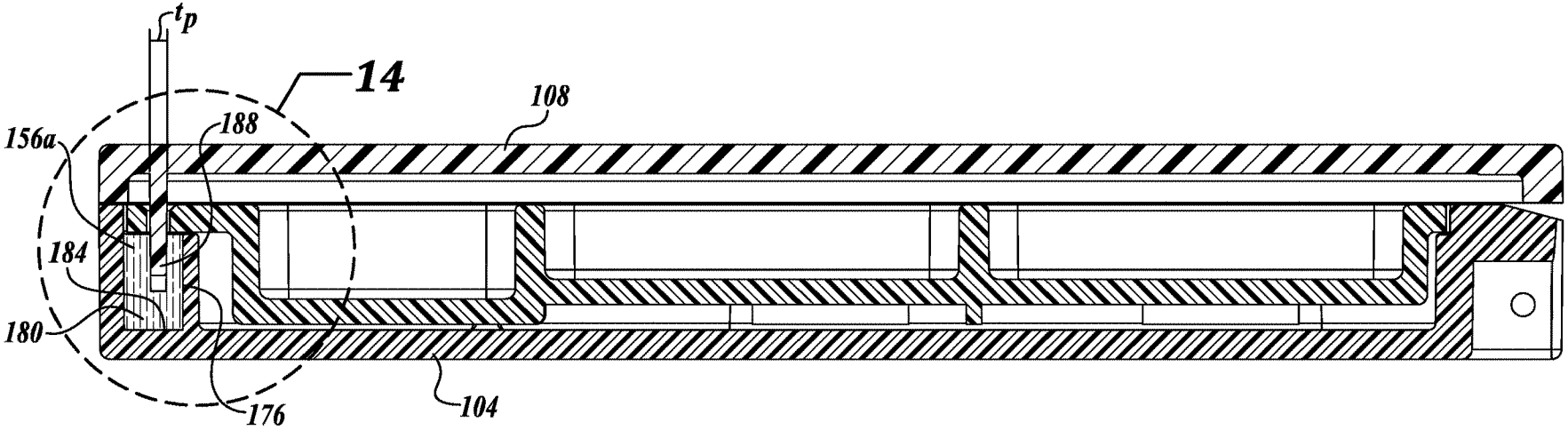
FIG. 13 is a side section view of the base and lid of FIG. 9.
Figure 14:
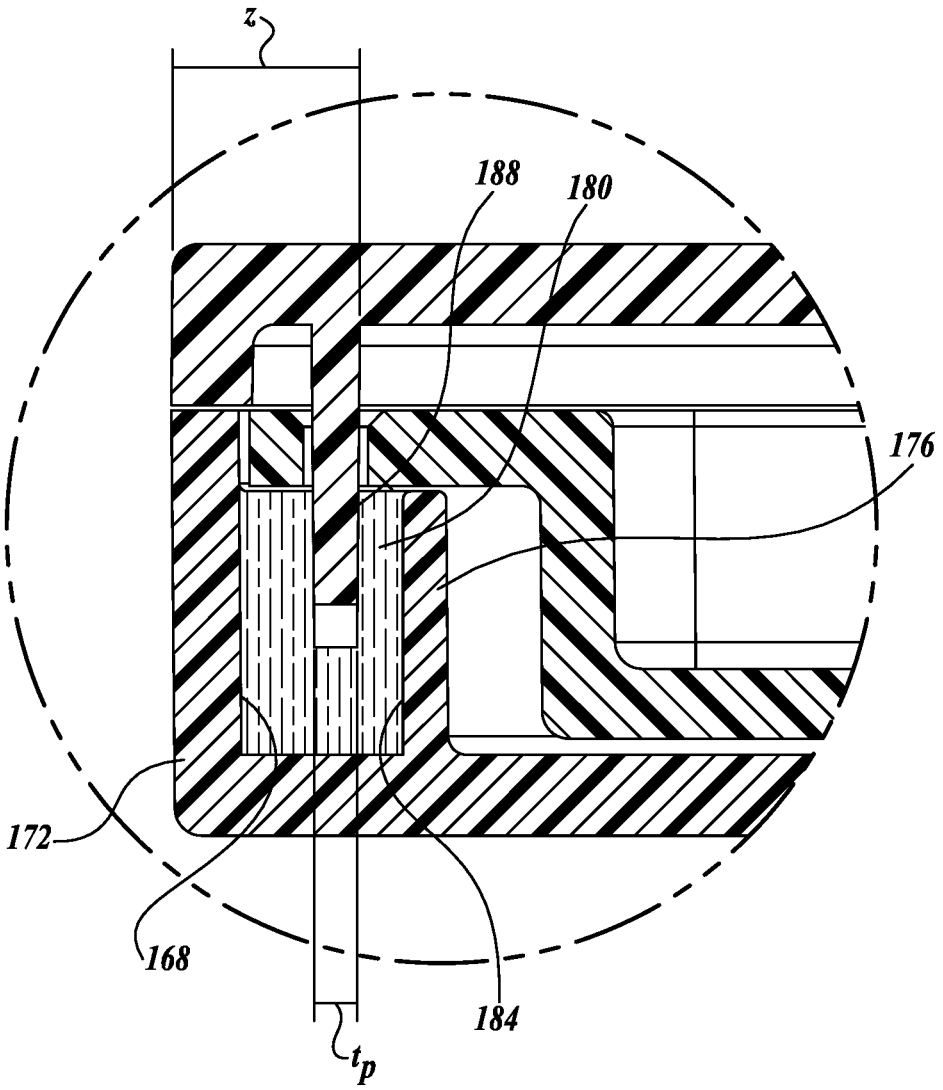
FIG. 14 is a partial side section view of the base and lid of FIG. 9.

Referring to FIGS. 13-14, to prevent the lid 108 from inadvertently opening, such as during e-commerce fulfillment, the packaging system 100 includes an adhesive deposit 180 located within each well 156. Each adhesive deposit 180 includes, for example, 0.2 ml of adhesive, though the adhesive amount may vary in some embodiments. Although FIGS. 13-14 show the adhesive deposit 180 in well 156*a*, well 156*b* includes a substantially identical adhesive deposit; therefore, all following description of the adhesive deposit 180 and the adhesive bonds applies equally to the adhesive deposits and adhesive bonds located in wells 156*a* and 156*b*.

The adhesive deposit 180 forms a first plurality of adhesive bonds 184 at surfaces of the well 156*a*. Similarly, the adhesive deposit 180 forms a second plurality of adhesive bonds 188 at surfaces of the corresponding protrusion 128*a*. The first plurality of adhesive bonds 184 covers, for example, about 135 $mm^2$ of the well 156*a*. The second plurality of adhesive bonds 188 covers, for example, about 50 $mm^2$ of the protrusion 128*a*. Because the first plurality of adhesive bonds 184 covers a greater surface area than the second plurality of adhesive bonds 188—about 2.7× more in this embodiment—the second plurality of adhesive bonds 188 are designed to break first. For this reason, after the adhesive bonds 188 break, the adhesive deposit 180 advantageously remains within the well 156*a*, where it remains largely out of sight and does not interfere with normal operation of the lid 108 and base 104.

In some embodiments, the adhesive deposits may cover about 50 $mm^2$ to about 500 $mm^2$ of surface area of the base (including all wells), for example about 100 $mm^2$, about 125 $mm^2$, about 150 $mm^2$, about 175 $mm^2$, about 200 $mm^2$, about 300 $mm^2$, about 400 $mm^2$, about 450 $mm^2$, about 500 $mm^2$, or any different area within that range, regardless of how much surface area of the lid the adhesive deposit covers. Likewise, the adhesive deposits may cover about 50 $mm^2$ to about 500 $mm^2$ of surface area of the lid (including all protrusions), including all exemplary values described above with respect to the base.

The ratio between the base surface area and the lid surface area covered by the adhesive deposit 180 may therefore range from about to about 0.1 to about 10.0, for example about 0.2, about 0.3, about 0.4, about 0.5, about 0.6, about 0.7, about 0.8, about 0.9, about 1.0, about 2.0, about 3.0, about 4.0, about 5.0, about 6.0, about 7.0, about 8.0, about 9.0, and any other ratio in that range. When the aforementioned ratio is greater than 1.0, the second plurality of adhesive bonds 188 (i.e., those formed with the protrusions) may tend to break first (e.g., break from the lid 108 before the base 104); when the ratio is less than 1.0, the opposite is true.

In the embodiment of FIGS. 9-13, the first and second pluralities of adhesive bonds 184, 188 (including bonds formed in both the first and second wells 156*a* and 156*b*), together with the closure structures 152, 154 of the user input region 140, are configured to retain the lid 108 in the closed position until the application of a lid force $L_F$ in excess of about 20N, at which time the second plurality of adhesive bonds 188 is configured to break. In other words, in the embodiment shown, the second plurality of adhesive bonds 188 and the closure structure 152 are configured to withstand an initial lid force $L_F$ of up to about 20N before the lid 104 opens (i.e., the second plurality of adhesive bonds 188 and the closure structure 152 are configured to exert a combined retention force of about 20N before the lid 104 opens). The second plurality of adhesive bonds 188 is configured to alone withstand a lid force $L_F$ of up to about 10N (or at least about 10N in some embodiments). A lid force $L_F$ of more than about 20N will cause the second plurality of adhesive bonds 188 to break at the protrusions $\mathbf{128}_{a,\ b}$ and the closure structure 152 to release. In some embodiments, the second plurality of adhesive bonds 188 and the closure structure 152 may be configured to withstand an initial lid force $L_F$ of about 8N to about 11N. In some embodiments, the second plurality of adhesive bonds 188 may alone be configured to withstand an initial lid force $L_F$ of about 4N to about 6N.

Figure 10:
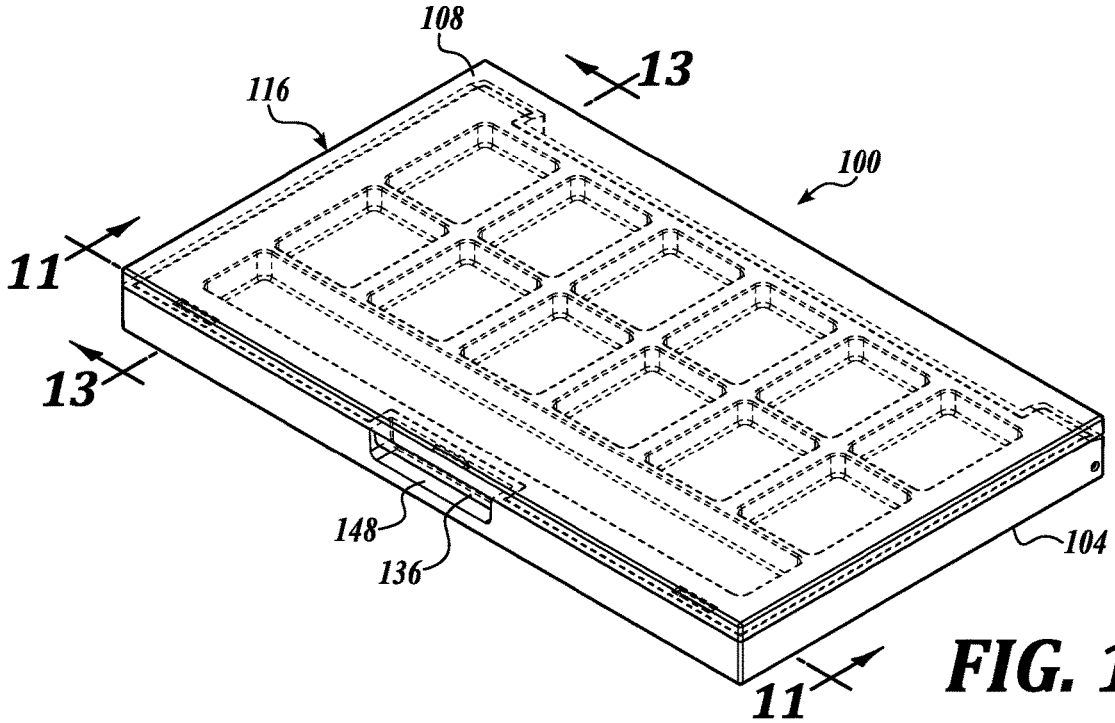
FIG. 10 is a section view of the base and lid of FIG. 9, showing the lid in a closed position.

When viewed from the side as in FIG. 14, it can be seen that the second plurality of adhesive bonds 188 (i.e., those designed to break first) are offset from the edge of the lid 108 (in this case, also the edge of the user input region 140) by a distance z, which is less than or equal to 2.6 mm in this embodiment. The relatively small offset between the second plurality of adhesive bonds 188 and the user input region 140 reduces the amount of adhesive required to resist a given lid force $L_F$. Some embodiments may include one or more adhesive bonds that are offset from the user input region and/or an outer edge of the base and/or the lid by a different distance that is 0 mm to about 100 mm, for example 0 mm, about 1.0 mm, about 2.0 mm, about 3.0 mm, about 4.0 mm, about 5.0 mm, about 10.0 mm, about 20.0 mm, about 25.0 mm, about 50.0 mm, about 75.0 mm, or any other offset distance in that range. Referring to FIGS. 9-11, it can be seen that the protrusions $\mathbf{128}_{a,\ b}$ are located on opposite sides of the user input region 140. In summary, the packaging systems of the present disclosure include one or more adhesive deposits at locations selected to increase the lid force that is necessary to open the package in the first instance after the adhesive deposits form adhesive bonds with the lid and base, thereby reducing the likelihood that the lid inadvertently opens, such as during e-commerce fulfillment. After the packaging systems are opened for the first time, the minimum force required to open the lid decreases to a level that is acceptable for repeated cycles by a user.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to one wiping assembly may be adapted for use with any other wiping assembly.

Although certain descriptive terms have been used to illustrate or describe certain aspects or benefits of the presently disclosed subject matter, they should not be seen as limiting. For instance, the present disclosure also includes references to directions, such as "distal," "proximal," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" should be interpreted broadly to include any cosmetic formulation, beauty product, lotion, lacquer, etc., generally applied to the skin, eyes, nails, or other body part of a person. Moreover, it should be appreciated that the cosmetic applicators may also be adapted for other non-cosmetic uses, such as applying medicine, paint, etc., to a desired body part or surface.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about," "approximately," etc., mean plus or minus 5%. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A packaging system, comprising:

a base having a well;

a lid hingeably connected to the base, the lid having a user input region and a protrusion projecting into the well;

a closure structure configured for releasably retaining the lid in a closed position relative to the base; and an adhesive deposit located within the well and at least partially surrounding the protrusion, the adhesive deposit forming a first plurality of adhesive bonds with the well and a second plurality of adhesive bonds with the protrusion, wherein the second plurality of adhesive bonds and the closure structure are configured to exert a combined retention force of at least 20N which resists a lid force $F_L$ applied to the user input region of the lid, wherein when the lid force $F_L$ exceeds the combined retention force, the second plurality of adhesive bonds break.

2. The packaging system of claim 1, wherein the closure structure alone is configured to exert a closure structure retention force of at least 10N, wherein the closure structure retention force is a component of the combined retention force.

3. The packaging system of claim 2, wherein the closure structure includes part of a hinge, wherein the second plurality of adhesive bonds is offset from the user input region by less than 10.0 mm in between the user input region and the hinge.

4. The packaging system of claim 1, wherein the first plurality of adhesive bonds cover a first surface area of the well and the second plurality of adhesive bonds cover a second surface area of the lid that is 50 $mm^2$ to 150 $mm^2$.

5. The packaging system of claim 4, wherein the first surface area is greater than the second surface area.

6. The packaging system of claim 5, wherein a ratio of the first surface area to the second surface area is 2.0 to 10.0.

7. The packaging system of claim 5, wherein the adhesive deposit contains less than or equal to 0.3 g of adhesive.

8. The packaging system of claim 5, wherein the adhesive deposit contains less than or equal to 0.5 ml of adhesive.

9. The packaging system of claim 1, wherein the at least one of the first plurality of adhesive bonds is formed at a surface having a first roughness, and at least one of the second plurality of adhesive bonds is formed at a surface having a second roughness, the first roughness being greater than the second roughness.

10. The packaging system of claim 1, wherein the closure structure is part of at least one of the base and the lid.

11. The packaging system of claim 1, wherein the second plurality of adhesive bonds is configured to permanently retain the adhesive deposit within the well.

12. The packaging system of claim 1, wherein the well is open on a bottom side.

13. The packaging system of claim 12, wherein an upper wall of the base obstructs the adhesive deposit from being removed from the well.

14. The packaging system of claim 1, further comprising a container that attaches to the base.

15. The packaging system of claim 1, further comprising a second protrusion opening that opens into a second well, and a second protrusion projecting through the second protrusion opening and into the second well.

16. The packaging system of claim 15, wherein the protrusion and the second protrusion are located on opposite sides of the user input region.

17. The packaging system of claim 15, further comprising a tray configured to fit within the base, wherein the base, the tray, and the lid together substantially form a makeup compact.

* * * * *